US010832845B2

(12) United States Patent
Fangauer et al.

(10) Patent No.: US 10,832,845 B2
(45) Date of Patent: Nov. 10, 2020

(54) ELECTROMAGNETIC ACTUATING DEVICE WHICH IS MONOSTABLE IN THE CURRENTLESS STATE AND USE OF SUCH AN ACTUATING DEVICE

(71) Applicant: ETO Magnetic GmbH, Stockach (DE)

(72) Inventors: Philipp Fangauer, Constance (DE); Peter Vincon, Stockach (DE)

(73) Assignee: ETO Magnetic GmbH, Stockach (DE)

( * ) Notice: Subject to any disclaimer, the term of this patent is extended or adjusted under 35 U.S.C. 154(b) by 119 days.

(21) Appl. No.: 16/092,939

(22) PCT Filed: Mar. 30, 2017

(86) PCT No.: PCT/EP2017/057619

§ 371 (c)(1),
(2) Date: Oct. 11, 2018

(87) PCT Pub. No.: WO2017/178241

PCT Pub. Date: Oct. 19, 2017

(65) Prior Publication Data

US 2019/0122798 A1 Apr. 25, 2019

(30) Foreign Application Priority Data

Apr. 13, 2016 (DE) ..... 10 2016 106 805

(51) Int. Cl.
*H01F 7/08* (2006.01)
*H01F 7/16* (2006.01)
*H01F 7/122* (2006.01)

(52) U.S. Cl.
CPC ..... *H01F 7/1615* (2013.01); *H01F 7/081* (2013.01); *H01F 7/122* (2013.01); *H01F 7/1646* (2013.01);

(Continued)

(58) Field of Classification Search
CPC ..... H01F 7/1615; H01F 7/1646; H01F 7/081; H01F 2007/086; H01F 2007/1669

(Continued)

(56) References Cited

U.S. PATENT DOCUMENTS 4,046,244 A * 9/1977 Velazquez ..... B41J 2/285 400/124.17
5,198,789 A * 3/1993 Taylor ..... H01H 50/541 335/132

(Continued)

FOREIGN PATENT DOCUMENTS

CN 102052454 A 5/2011
DE 20114466 A1 1/2002

(Continued)

OTHER PUBLICATIONS

International search report for application No. PCT/EP2017/057619 dated Nov. Jun. 26, 2017.

*Primary Examiner* — Shawki S Ismail
*Assistant Examiner* — Lisa N Homza
(74) *Attorney, Agent, or Firm* — Bachman and Lapointe PC; George Coury

(57) ABSTRACT

An electromagnetic actuating device includes an armature, which has a permanent magnet and can move along a longitudinal axis between actuation positions relative to a stationary coil and in reaction to energization, armature has an engagement section for interacting with a plunger, and which armature can move from a first actuation position, which is stable in the currentless state, into a second actuation position against a restoring force of a spring, wherein the coil has a first coil unit, which acts on the armature and which releases the armature from the first actuation position, wherein the coil has a second coil unit which, during movement, applies to the armature a force which accelerates the armature, and wherein the coil has a (Continued)

restoring coil such that when the armature is returned from the second into the first actuation position, the restoring coil boosts the restoring force of the spring.

16 Claims, 2 Drawing Sheets

(52) U.S. Cl.
CPC ..... *H01F 2007/086* (2013.01); *H01F 2007/1669* (2013.01); *H01F 2007/1692* (2013.01)

(58) Field of Classification Search
USPC ..... 335/229
See application file for complete search history.

(56) References Cited

U.S. PATENT DOCUMENTS

| | | | | |
|---|---|---|---|---|
| 2011/0001591 | A1* | 1/2011 | Puth | H01F 7/1615 335/229 |
| 2011/0248804 | A1 | 10/2011 | Wygnanski | |
| 2014/0313000 | A1* | 10/2014 | Sackl | H02K 33/00 335/229 |
| 2015/0102877 | A1* | 4/2015 | Gruener | H01F 7/1607 335/262 |
| 2015/0213936 | A1* | 7/2015 | Burner | H01F 7/122 123/90.17 |
| 2016/0118174 | A1* | 4/2016 | Bereschka | H01F 7/13 335/229 |
| 2017/0321689 | A1* | 11/2017 | Fangauer | F16K 31/0655 |

FOREIGN PATENT DOCUMENTS

| | | | |
|---|---|---|---|
| DE | 102007057882 | A1 | 6/2009 |
| DE | 202009014192 | U1 | 4/2011 |
| DE | 102010050382 | A1 | 6/2011 |
| WO | 2011026553 | A1 | 3/2011 |
| WO | 2011047801 | A1 | 4/2011 |

* cited by examiner

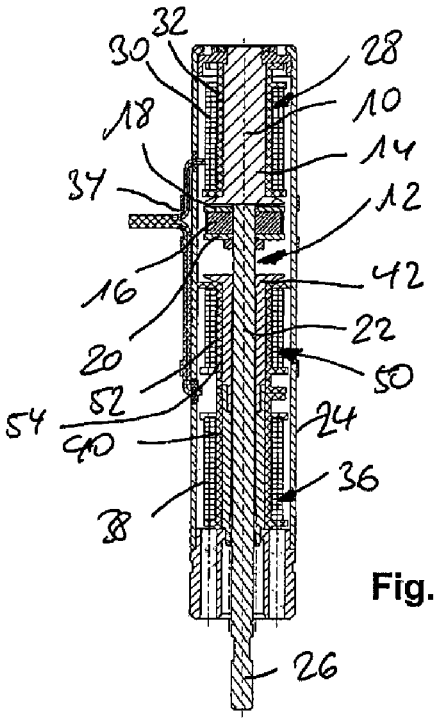
Fig. 1
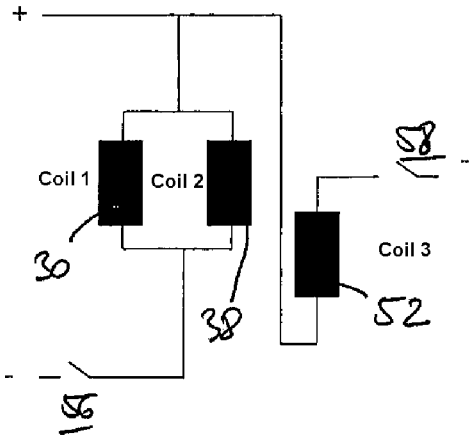
Fig. 2
Fig. 3 (a) (b) (c)
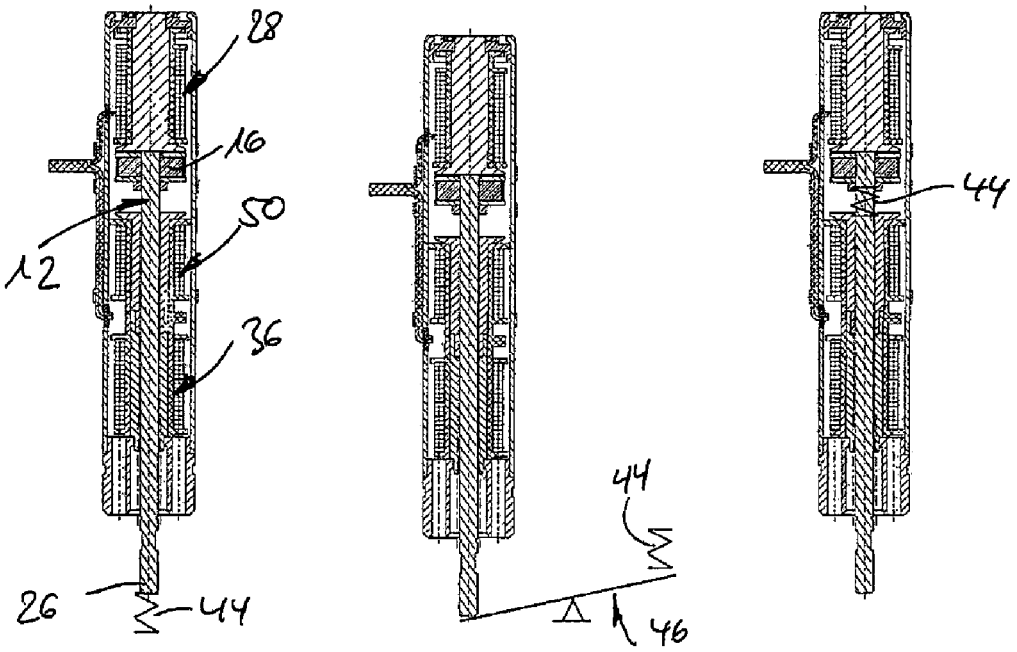

ELECTROMAGNETIC ACTUATING DEVICE WHICH IS MONOSTABLE IN THE CURRENTLESS STATE AND USE OF SUCH AN ACTUATING DEVICE

BACKGROUND OF THE INVENTION

The present invention relates to an electromagnetic actuating device, which is monostable in the currentless state. The present invention further relates to a use of such an electromagnetic actuating device, which is monostable in the currentless state.

Electromagnetic actuating devices can be assumed as being well known from the prior art. For instance, DE 201 14 466 U1 by Applicant thus discloses a bistable electromagnetic actuator device as actuating device, which has an armature unit comprising permanent magnetic means as well as a plunger slide unit, which is elongated along a direction of movement and which sits on the armature unit. This permanent magnetic armature unit is driven by stationary electromagnetic drive means in the form of a stationary core unit, to which a suitably energizable coil unit is assigned. In particular for the purpose of an improvement of an extracting of the armature unit, i.e. a movement of the armature unit away from a first (retracted) actuation position, which is stable in the currentless state made possible by permanent magnetic adhesive effect on the core unit, a compression spring can additionally be provided, which pretensions the armature unit in the direction of a releasing from the core unit. The entire arrangement is enclosed by a magnetically conductive housing, which closes the magnetic circuit necessary for the movement, and which, in the extracted armature position, i.e. released from the stationary core unit, offers an opposite adhesive position, in interaction with the armature-side permanent magnetic means, so that the device from DE 201 14 466 U1 is a bistable device.

On the end side and based on an engagement or actuation partner, respectively, in the described prior art an adjusting groove of a combustion engine, which is embodied for camshaft adjustment, the plunger section forms an engagement section, which is in particular suitable to engage with this adjusting groove in an extracted armature state and to then carry out the intended camshaft adjustment in this way. In the case of this prior art, a restoring (returning) of the armature unit together with plunger section into the inserted (retracted) position on the core unit typically takes place in this prior art by the effect of the actuation or engagement partner, respectively, here concretely by means of suitable design of the profiled groove.

Such technology, which is assumed to be known, has not only established itself in general in the technical field of the camshaft adjustment of combustion engines, wherein, in addition to high switching cycle numbers and long service lives of the known devices in particular also an automatable producibility and mountability ensure a wide dissemination of the technology.

WO 2011/026553 by Applicant further discloses a bistable electromagnetic actuating device, in the case of which an armature unit, which is provided with permanent magnetic means, can again be moved between two actuation positions in reaction to energization of a stationary coil unit, wherein an engagement section for interaction with a suitably assigned unit as actuation partner can be provided here axially at either end. The permanent magnetic means, which are provided on the armature side, again ensure that the armature unit is kept stable in the currentless state at either end, i.e. in respective opposite end-side stop positions, in other words that it remains stable in the respective end-side stop position without energizing the coil unit again or without externally influencing the armature unit, respectively. In the case of this prior art, the releasing or returning, respectively, into a respective opposite one of the stop positions now takes place by means of a pole change of the energization of the coil unit, so that the respective end or stop positions, respectively, can also be reached so as to be controlled in this way.

However, in particular in a motor vehicle context (but not only here, the same applies for instance also for various applications in the industrial control technology), it is often necessary to ensure that, in addition to an actuation or end position, respectively, which is stable in the currentless state, a defined movement or actuation position, respectively, of the armature unit is assumed by the actuating device, for instance in response to a power failure—this is also identified as "fail safe" and faces the problem, for instance, that even though the respective (opposite) end positions can be reached and held (also currentless) in the case of the described bistable actuating devices from the prior art, it can then often no longer be reconstructed in particular after an (unintentional) power failure, which actuating process had been performed last and thus at which actuation position the armature unit together with plunger section is located. This then leads to uncertain and potentially damage-prone actuating processes.

It goes without saying that, on principle, it is possible to design the actuating devices described with regard to the prior art to be monostable, for instance in that—e.g. by means of springs or similar means, which create a counter force—an automatic retraction into only one of the two actuation positions occurs in the case of non-energization. However, this is already not unproblematic and potentially disadvantageous in particular in the case of the described technologies, because in particular the armature-side permanent magnetic means, in particular in the case of a (typical) magnetically conductive housing of the actuating device (which is typically also necessary to effect the actuating functionality), adhere to respective end positions, thus then initially create the adhesive effect—in a bistable manner—at that location. Moreover, for instance a spring, which creates a restoring or counter force, reduces the efficiency of the entire arrangement, because the counter force of this restoring spring has to then also be overcome by way of a movement out of the core-side stop position, in addition to the permanent magnetic attraction, which is also already effective at that location. In addition to disadvantageous consequences for the efficiency, this also leads to inferior dynamic behaviors, i.e. an armature acceleration decreases and the time required for extracting the armature unit together with plunger section increases accordingly, which is to frequently be avoided in particular in motor vehicle environments.

In addition, there is the disadvantage in particular in the case of the former widespread prior art according to DE 201 14 466 U1 that a compression spring, which releases the armature unit from the first actuation position, is often provided there in the first place to improve this dynamic behavior, so that a (theoretically conceivable) restoring spring would also initially be counterproductive or problematic here, respectively.

SUMMARY OF THE INVENTION

It is thus the object of the present invention to create an electromagnetic actuating device, which, in addition to favorable dynamic properties, in particular a quick moving of an armature unit having a permanent magnetic means from a first (extracted) actuation position into a second (extended) actuation position, has a calculatable restoring behavior, which can be predetermined in the currentless or non-energized case, respectively, which can thereby in particular be produced in a structurally simple manner and with little hardware effort, and which can also be manufactured in an automated manner for the large-scale production.

The object is solved by means of an electromagnetic actuating device, which is monostable in the currentless states, comprising the features disclosed herein; advantageous further developments of the invention are also described herein and in the subclaims. Independent protection in the context of the invention is claimed for a use of an electromagnetic actuating device, which is monostable in the currentless state, for setting an operating mode of a vehicle unit, wherein a gear locking represents a particularly preferred form of this use.

In a manner, which is advantageous according to the invention, the coil means according to the invention initially have a second coil unit, which is provided in addition to the first coil unit, and which is connected or can be connected in such a way according to the invention that this second coil unit is additionally accelerated to the armature unit in response to a movement of the armature unit from the first (typically non-extracted) actuation position, into the second (extracted) actuation position. It is advantageously ensured thereby that in spite of the force storages (for instance a spring), which are provided according to the invention and which are designed for the restoring, no disadvantageous influencing of the dynamic behavior occurs in response to the extracting, the second coil unit according to the invention does in fact compensate or even overcompensate a possible disadvantageous counter or restoring force, receptively, of the force storage means by the second coil unit.

In the context of preferred embodiments of the invention, it can be expedient thereby to continue to energize the first and the second coil unit (in the alternative: also the second coil unit in an isolated manner in response to corresponding connection), when, after the extracting (i.e. moving the armature unit into the second actuation position), this second actuation position is reached. It is advantageously attained by providing corresponding energization means, which are connected upstream or which are to be connected upstream, respectively, of the first or second coil unit, to lower the flowing current with respect to the movement and to thus ensure an armature position, the electrical energy consumption of which is reduced and which is extracted (albeit energized).

According to the invention, the coil means additionally have restoring coil means, which are embodied or connected in such a way, respectively, that they have the effect of boosting the force storage means in response to the restoring, namely the returning of the armature unit from the second into the first actuation position, thus exert an additional restoring force in the same direction as the force storage means (thus e.g. the restoring spring). This then does not only ensure monostability, namely by the effect of the force storage means, and the reaching of a stable unambiguous actuation state in the currentless state (in terms of the fail-safe condition), the restoring coil means according to the invention advantageously also make it possible that the restoring movement does not need to take place by the spring means alone, but that a controlled, dynamic (i.e. quick) restoring from the second into the first actuation position can take place for instance in an activated or energizing state of the device, respectively.

The present invention thus realizes a functionality, which, in a surprisingly simple manner, combines the dynamic advantages of a known bidirectional, albeit bistable actuating device with the necessity of bringing about an unambiguous actuation state, which is stable in the currentless state, without this influencing the actuation, efficiency and dynamic properties of the invention in a disadvantageous manner.

In particular in light of ensuring an operationally reliable restoring of the armature unit into the first actuation position in the currentless or in the non-energized state, respectively, of all coil units, the restoring force of the force storage means is set up in an advantageous manner and so as to form a further development according to the invention (thus for instance by means of a suitable dimensioning of spring means, which are to be provided for this purpose) in such a way that this restoring force is greater than a permanent magnetic adhesive force of the permanent magnetic means at the second actuation position, wherein this adhesive force would take place for instance with respect to a surrounding housing of the actuating device (which would then provide for instance for an exit of the plunger section in an otherwise known manner).

As a result of a first preferred embodiment, the restoring coil means are realized as additional coil unit, so that as third coil unit, which is to be provided in addition to the first and the second coil unit and which more preferably is provided in the area of the second actuation position or which is electromagnetically positioned into the predetermined or resulting circuits, respectively, in such a way that this additional coil unit, as restoring coil means, can exert the desired restoring force (i.e. in the same direction as the restoring force of the force storage means or overlapping them, respectively). From a structural-geometric aspect, it is thereby particularly preferred to provide this additional coil unit axially adjacent to the second coil unit (wherein the direction of extension or movement, respectively, of the armature unit together with typically elongated plunger section is to be understood as "axial" in the context of the invention). In the context of such a configuration, this additional coil unit would then, in the context of a coil magnetic flow, typically also interact with a stationary core section, which, in a further development according to the invention, is assigned to the second coil unit, and is thus typically provided axially opposite a core unit, which determines the first actuation position or which forms a stop for the armature unit on the first actuation position, respectively.

An alternative embodiment of the restoring coil means according to the invention nevertheless provides that these restoring coil means are not realized by means of an additional, separate coil, but that the first and second coil unit according to the invention also effects the functionality of the restoring coil means, namely when pole changing means, which are connected upstream or which are assigned, respectively, of an energization of the first and second coil unit for the restoring operation of the restoring coil means change the polarity of the energization of the first or second coil unit, respectively, in such a way that instead of a force, which leads out or which extracts, respectively, the intended restoring force acts on the armature unit in the manner as provided according to the invention.

Further developments according to the invention provide for various alternatives for implementing the force storage means according to the invention—which ensure the currentless monostable return and thus the desired fail-safe behavior with respect to a predetermined actuation position in the manner as discussed above: On the one hand, it is thus preferred in the context of a preferred embodiment to realize these force storage means, typically as compression spring, as spring, which acts externally on the armature unit in the area of the engagement section. Such an alternative is in particular suitable for those exemplary embodiments, in the case of which the plunger end, in addition to the interaction with the actuation partner, is also favorably suitable or embodied to accommodate a compression spring, which acts here or which engages with the armature unit, respectively. In addition or in the alternative, this can also take place indirectly via deflecting means, wherein for instance a tilt lever or similar mechanical units then apply a restoring force from spring means, which do not directly engage with the armature unit, into the latter in the manner according to the patent.

In the alternative or in addition, a (restoring) compression spring can also be provided in a device housing itself and should be provided for instance in a suitable manner axially at a predetermined position of the armature unit or the plunger section thereof, respectively. In a further development, it could be expedient and structurally elegant here to embody the compression spring as helical spring in such a way that it surrounds the plunger section and is for instance supported axially at one end of the permanent magnetic means armature section (which is typically widened as compared to the plunger section).

As a result, the present invention provides for the realization of an actuating device, which is monostable and which assumes a defined actuation state, in the currentless state, in a simple and elegant manner, which combines structural simplicity with favorable, advantageous actuating properties in both actuating directions, without force storage means, which bring about a restoring, for instance, negatively influence the behavior. The present invention is thus excellently suitable for an intended purpose in the area of the setting of an operating mode of a vehicle unit, such as for instance of a motorcycle transmission, wherein the present invention, however, is not necessarily limited to such an intended purpose.

BRIEF DESCRIPTION OF THE DRAWINGS

Further advantages, features and details of the invention follow from the description below of preferred exemplary embodiments as well as by means of the drawings;

FIG. 1: shows a longitudinal sectional view of the electromagnetic actuating device according to a first exemplary embodiment of the invention (without spring means);

FIG. 2: shows a main block diagram for energizing the three coil units in the exemplary embodiment of FIG. 1;

FIG. 3: shows, with partial Figures (a) to (c), various alternatives for providing the force storage means according to the invention at the armature unit in the exemplary embodiment of FIG. 1;

In the following discussion of the exemplary embodiments, identical reference numerals signify functional components, which are identical or have the same effect, respectively, in the case of the electromagnetic actuating devices of the respective embodiment.

DETAILED DESCRIPTION

Figure 4:
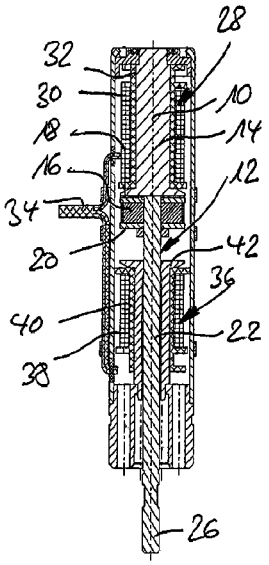
FIG. 4: shows a longitudinal sectional view through the electromagnetic actuating device according to a second exemplary embodiment of the invention.

For instance, the longitudinal sectional view of the first embodiment of FIG. 1 thus shows an armature unit 12, which can be moved along a longitudinal axis 10 and which, at a first end, which is directed towards a first core unit 14, has a permanent magnetic disk 16, which is axially defined at both ends by flow guide disks 18, 20. This permanent magnetic unit is followed by an elongated plunger section 22 of the armature unit, which extends along the axial direction in the center of an encompassing cylindrical housing 24, all the way to an open housing end (shown in FIG. 1 on the bottom side), from which an engagement section 26 is then embodied—embodied for interacting with an actuation partner, which is provided here in a motorcycle transmission.

The first stationary core element 14 is enclosed in the manner known for instance from the prior art according to DE 201 14 466 U1 by a first coil unit 28, which has a first winding 30 on a coil support 32 (which is realized, e.g. as plastic injection molded part). On the front side, i.e. at the end of the housing 24 opposite the engagement section 26, it is closed in otherwise known manner in a magnetically fluidically conductive manner in such a way that, in reaction to energization of the first winding 30 (here by means of a schematically shown supply line structure 34), the coil 30 forms an application of force, which repels the permanent magnetic means 26 and which is thus directed downwards along the axial direction in the drawing of FIG. 1. The arrangement is thereby configured in such a way that this repelling effect is (already) sufficient to overcome the permanent magnetic adhesive force of the assembly 16 on the first core 14, so that this movement can take place.

In the context of the shown embodiment, this movement is additionally supported by a second coil unit 36, which has a second winding 38 wound onto a plastic coil support 40. In the case of energization for moving the armature unit from the (first) actuation position of FIG. 1 downstream, this winding 38, supplied via the supply arrangement 34, is also energized in such a way (and it is set up or poled, respectively, in such a way) that the coil 38 exerts a force, which supports the repelling by the first coil unit 28, on the permanent magnetic unit 16, in other words, additionally exerts a pulling action to improve the acceleration and dynamic properties, with corresponding positive impact on a short actuation and movement time of the armature into a second actuation position, which is directed downwards onto a second stationary core 42, wherein this second actuation position, possibly also spaced apart by an armature adhesive disk provided on the armature side, is bounded by a stop formed by the second core 42. The second core unit—surrounding the plunger section 22 on the circumferential side in the shown manner and offering a guide for it to this effect—together with the second coil 38 as well as a corresponding jacket-side section of the housing 24, forms a magnetic flow circuit, which realizes the described boosting actuating effect of the second coil unit.

The returning of a movement of the armature unit extracted in the described manner (i.e. directed downwards in the direction of a stop at the second core 42) takes place against a restoring force of a spring unit, which is not shown in FIG. 1 and which pretensions the armature unit into an upwards direction (i.e. back into the first actuation position at the first core 14), as shown schematically in connection with FIG. 3 and the partial figures as alternatives (a) to (c): otherwise structurally identical with the longitudinal sectional view of FIG. 1, various options are shown here, how a pressure spring 44 can apply the described restoring force, which is directed in the direction back to the first actuation position, into the armature unit or can then also effect such a restoring in the case of a corresponding compression. For instance, FIG. 3(*a*) shows a spring element, which is directed onto a front end of the engagement section 26 on the front side, in a schematic manner, the partial figure (b) shows a compression spring across a tilt lever 46 (only shown schematically) as possible alternatives, while, again as alternative (but possibly also when providing two springs additionally) the spring element 44 in the partial image (c) of FIG. 3 is accommodated in the housing interior of the housing 24 in such a way that the pressure spring 44, surrounding the plunger section 22 adjacent to the permanent magnetic unit, is supported at one end on a stop surface of the second core 42 and, at the other end, engages with the flow guide disk 20, which is directed in the direction of the second core.

A spring force or a force behavior of the spring 44, respectively, is thereby set up in such a way that the spring force at the second actuation position (thus at the stop of the armature unit, which is not shown in the Figures, or the permanent magnetic means 16 thereof, respectively, at the second core 42) does not result in a (permanently magnetic) bonding or adhering, respectively, on the core, but this permanently magnetic adhesive force is in fact overcome by means of the above-described restoring force of the spring element 44.

In addition, the first exemplary embodiment of FIGS. 1 to 3 shows a third coil unit 50, which, in the illustrated exemplary embodiment, is provided axially and adjacent in the direction of the first coil unit 28 of the second coil unit 36; in the described exemplary embodiment, the coil support 54, which supports a third coil (winding) of the third coil unit, is also embodied for the module-like assembling, in the alternative in one piece, with the coil support 40 of the second coil unit 36, so that these units are in particular suitable for a compact and potentially automatic manufacturing and assembly.

In the described exemplary embodiment, the third coil 32 is connected or set up in such a way, respectively, that in the case of the described actuating process from the first actuation position (at the core 14) into the second actuation position (at the core 42), the third coil remains non-energized, but the third coil then exerts a restoring force on the armature unit in the direction of the first actuation position in a restoring operation—in the case of a non-energized state of the first and of the second coil—thus overlaps or boosts, respectively, the restoring force of the restoring spring 44 in this respect.

The circuit diagram of FIG. 2 clarifies such a wiring; the shown switches 56 (for the arrangement of first coil 30 and second coil 38) or 58 (for the third coil 52), respectively, are thereby alternatively closed and thus determine the operating state for moving the armature unit from the first into the second actuation position, when the switch 56 is closed and the switch 58 is open, while the reverse switch state (switch 56 open and switch 58 closed) effects the third coil 52 for returning into the first actuation position, supported by the spring restoring force of the spring unit 44. It becomes clear that the restoring process runs dynamically and in an accelerated manner, in particular also by means of this measure, and that a monostability is thus made possible, which is not disadvantageously influenced by a possible adhesive behavior of the permanent magnet 16 at the second armature, this is in fact compensated by the coil 52.

It becomes clear at the same time that even in the case of no energization, thus also for instance in the case of a power failure state, which is potentially problematic in the prior art, as a result of the still existing restoring effect of the spring 44, a secure and defined returning of the armature unit into the first actuation position (at the first core 14) is ensured, so that it is ensured even in the case of a completely non-energized operating phase that the armature unit 12 is in a defined currentless and rest position (fail safe) with its engagement-side end 26, here in a retracted (upper) operating state of FIG. 1.

Figure 5:
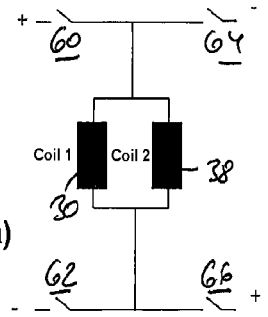
FIG. 5: shows, with partial Figures (a) or (b), respectively, possible schematic circuit diagrams for energizing the two coil units in the exemplary embodiment of FIG. 4 so as to change the polarity.
Figure 5:
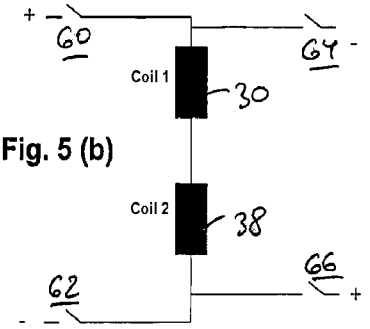
Figure 6:
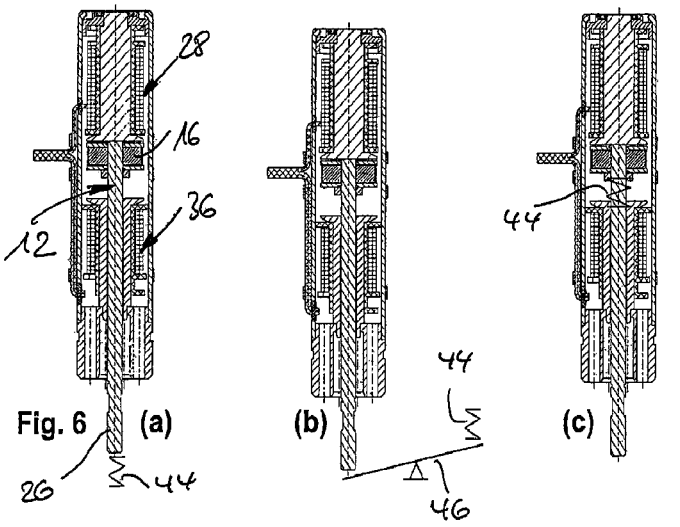
FIG. 6: shows, with partial Figures (a) to (c), various alternatives for providing the force storage means according to the invention at the armature unit in the exemplary embodiment of FIG. 4.

The second exemplary embodiment of FIGS. 4 to 6 structurally corresponds almost completely to the first exemplary embodiment of FIGS. 1 to 3, only with the difference that the second exemplary embodiment only has the first coil unit 28 and the second coil unit 36, but not the third additional restoring coil unit 50. An axially shorter and thus potentially more compact device can be realized in this respect. An electromagnetic restoring is nonetheless ensured, as illustrated for instance by the circuit diagrams of FIG. 5(*a*) or (*b*), respectively, via the spring-effected restoring of the spring element 44 (the function of the first alternatives of FIGS. 6(*a*) to (*c*) is equivalent and analogous to FIGS. 3(*a*) to (*c*) of the embodiment in this respect), but it takes place by means of the change of polarity of the interconnected coil pair 30, 38: In the described exemplary embodiment, a switch pair 60, 62 would thereby for instance provide the coils 30 and 38 with an energization of a first polarity, as it is the case for instance for realizing the armature movement, which has already been described in connection with the first exemplary embodiment, from the first actuation position (FIG. 4) into the second actuation position, which is directed downwards at the second core 42. In contrast, the restoring, which supports (the spring 44), would take place by means of a change of polarity of the energization of the coil pair 30, 38 in such a way that the switches 60, 62 are opened in response to this electromagnetically supported restoring, and switches 64, 66 instead apply the energization with the reversed polarity to the coil pair 30, 38. This then has the result that the coil 30 exerts an attracting force on the permanent magnet 16 (changed polarity) and the coil 38 exerts a repelling force on this permanent magnet, with the effect that, overall, a permanently magnetic restoring force, which overlaps the spring restoring force, takes place in the direction of the upper stop at the first core 14. According to FIG. 5(*a*), it is thereby possible to form a parallel connection of the coils, as well as, in the alternative circuit diagram of FIG. 5(*b*), to provide it as series connection.

The present invention is not limited to the shown exemplary embodiments, the formation, arrangement and embodiment of the individual coil units is in particular likewise suitable, can be changed or varied, respectively, as the present invention is not limited to the preferred application of a lock for (motorcycle) transmission. In fact, the present invention is suitable for any application, in which, with permanently magnetic armature functionality, dynamic actuating behavior can be combined in both axial actuating directions with monostability in the non-energized state or a defined fail-safe restoring position, respectively.

The invention claimed is:

1. An electromagnetic actuating device, which is monostable in the currentless state, comprising an armature unit (12), which has permanent magnetic means (16) and which can move along a movement longitudinal axis (10) between at least two actuation positions relative to stationary coil means (28, 50, 36) and in reaction to energization thereof, which armature unit (12) has an engagement section (26) for interacting with a plunger section (22), which provides an actuation partner and which armature unit (12) can be moved from a first of the actuation positions, which is stable in the currentless state as result of an effect of the permanent magnetic means, into a second of the actuation positions against a restoring force of force storage means (44), wherein the coil means have a first coil unit (28), which is connected or can be connected in order to bring about a force, which acts on the armature unit and which releases the armature unit from the first actuation position, wherein the coil means have a second coil unit (36), which is provided in addition to the first coil unit and is connected or can be connected in such a way that during the movement, the second coil unit applies to the armature unit a force, which accelerates the armature unit, and wherein the coil means have restoring coil means (50, 28, 36), which are embodied and/or connected in such a way that when the armature unit is returned from the second into the first actuation position, said restoring coil means (50, 28, 36) boost the restoring force of the force storage means.

2. The device according to claim 1, wherein the restoring force of the force storage means acting on the armature unit at the second actuation position is greater than a permanent magnetic adhesive force of the permanent magnetic means (16) at the second actuation position.

3. The device according to claim 1, wherein the restoring coil means are realized as additional coil unit (50).

4. The device according to claim 3, wherein the additional coil unit is provided in the area of the second actuation position and/or acts on the armature unit in a restoring manner.

5. The device according to claim 3, wherein the additional coil unit (50) is provided axially adjacent to the second coil unit (36), and/or is provided so as to magnetically interact with a stationary core section (42) assigned to the second coil unit.

6. The device according to claim 5, wherein the additional coil unit (50) is on a joint coil carrier.

7. The device according to claim 1, wherein energizing means are connected upstream or can be connected upstream of the first coil unit and the second coil unit in such a way that, in the case of the armature unit being located in the second actuation position, a continued energization of the first and of the second coil unit takes place, which introduces a lower current, in particular decreased by at least 20%, more preferably by at least 40%, into the first and second coil unit as compared to an energization, which follows during the movement into the second actuation position.

8. The device according to claim 7, wherein the lower current is decreased by at least 20% as compared to the energization which follows during the movement into the second actuation position.

9. The device according to claim 7, wherein the lower current is decreased by at least 40% as compared to the energization which follows during the movement into the second actuation position.

10. The device according to claim 1, wherein the restoring coil means are realized by the first and/or second coil unit and have polarity changing means (60-66), which act on this coil unit(s).

11. The device according to claim 1, wherein the force storage means are realized as compression spring (44) acting on the armature unit in the area of the engagement section.

12. The device according to claim 11, wherein the compression spring engages externally with the armature unit via deflecting means (46) via a tilt lever.

13. The device according to claim 11, wherein the compression spring is integrated in a housing of the electromagnetic actuating device and/or encompasses the plunger section axially adjacent to the permanent magnetic means.

14. A use of the electromagnetic actuating device, which is monostable in the currentless state, according to claim 1, for setting an operating mode of a vehicle unit, wherein the force storage means can establish a defined operating state in the currentless state of the actuating device for moving the armature unit into the first actuation position.

15. The use of claim 14, wherein the vehicle unit is a motorcycle transmission.

16. The device according to claim 1, wherein the force storage means (44) is a spring means.

* * * * *